US007438462B1

(12) United States Patent
Bodie et al.

(10) Patent No.: US 7,438,462 B1
(45) Date of Patent: Oct. 21, 2008

(54) SYSTEM OR METHOD FOR SHAKING A CONTAINER

(76) Inventors: Christine J. Bodie, 50044 Cooke Ave., Plymouth, MI (US) 48170; Daniel Jay Fields, 11045 Sandy Creek Dr., South Lyon, MI (US) 48178

( * ) Notice: Subject to any disclaimer, the term of this patent is extended or adjusted under 35 U.S.C. 154(b) by 386 days.

(21) Appl. No.: 10/803,864

(22) Filed: Mar. 18, 2004

(51) Int. Cl.
*B01F 11/00* (2006.01)

(52) U.S. Cl. ..... 366/197; 366/208; 366/209; 366/216; 366/218; 366/219; 366/239

(58) Field of Classification Search ..... 366/215, 366/216, 217, 218, 237, 239, 240, 113, 112, 366/110, 128, 197, 208, 209, 219
See application file for complete search history.

(56) References Cited

U.S. PATENT DOCUMENTS 1,866,531 A * 7/1932 Harding ..... 209/332
2,175,321 A * 10/1939 Saffir ..... 241/172
2,244,462 A * 6/1941 Keys ..... 134/86
2,255,799 A * 9/1941 Meinzer ..... 366/111
2,284,671 A * 6/1942 Meinzer ..... 209/325
3,159,384 A * 12/1964 Davis ..... 366/110
3,220,704 A * 11/1965 Phillips ..... 366/182.2
3,286,939 A * 11/1966 Karpenko et al. ..... 366/128
3,570,192 A * 3/1971 Ferrara ..... 451/327
3,813,816 A * 6/1974 Funk ..... 451/113
3,944,188 A * 3/1976 Parker et al. ..... 366/110
4,398,829 A 8/1983 Shick
4,422,768 A 12/1983 Solomon
4,497,581 A 2/1985 Miller
4,529,510 A 7/1985 Johnson et al.
4,619,532 A 10/1986 Schmidt, III
4,632,751 A 12/1986 Johnson et al.
4,673,297 A 6/1987 Siczek et al.
4,702,610 A * 10/1987 Reynolds, Jr. ..... 366/213
4,779,809 A * 10/1988 Miwa ..... 241/69
4,842,415 A 6/1989 Cane et al.
5,050,996 A 9/1991 Allen
5,060,151 A 10/1991 Mikyska et al.
5,183,334 A 2/1993 Geitslinger
5,273,357 A 12/1993 Currie
5,439,287 A 8/1995 Roepke, Sr.
5,462,353 A 10/1995 Gatlin (Continued)

OTHER PUBLICATIONS http://www.somatco.com/mixers.htm, pp. 1-6, no date.

*Primary Examiner*—Tony G Soohoo

(57) ABSTRACT

Methods and mechanisms for shaking containers are disclosed. The shaking motion can be made to vary in a dynamic fashion so that the different components within the container are not made to separate, as if subjected to the processing of a centrifuge. Such dynamic motion can appear to be random. A cantilevered base plate or other type of based place can be coupled to a base. A motor can be coupled to the base plate and configured to rotate a generally vertical shaft. A cam or other type of wheel can be coupled to the shaft and configured to eccentrically rotate about the shaft, wherein the wheel is configured to rotate within a bearing. A container base is coupled to the bearing such that the container base is configured to translate or otherwise move is general accordance with the eccentric rotation of the cam. The container base can be configured to tilt based at least in part on the translation of the container base.

22 Claims, 7 Drawing Sheets

U.S. PATENT DOCUMENTS 5,503,474 A 4/1996 Krzywdziak
5,638,628 A * 6/1997 Davis ..... 43/4.5
6,302,575 B1 10/2001 Anderson et al.
6,745,664 B2 6/2004 Kopkie
2002/0039327 A1 4/2002 Kopkie
2004/0013031 A1 1/2004 Salas et al.

* cited by examiner

SYSTEM OR METHOD FOR SHAKING A CONTAINER

BACKGROUND OF THE INVENTION

The present invention relates to systems, apparatuses and methods for shaking containers (collectively "shaker devices" or simply "shakers").

In conventional shaking devices such as a paint can shaker, a container is shaken to mix one or more substances within the container. Many shaking devices apply only limited motions to the container. Such limited motions often fail to thoroughly mix substances of different densities. Some motions used by conventional shakers act as a centrifuge and actually facilitate a separation of substances with different densities. The failure of shakers to implement a dynamically altering motion impedes the goals of the shaking process in many different contexts, including the shaking of paint, nail polish, glue, chemical cleaning agents, or any other context in which the separation of different substances is not a desirable outcome.

Conventional shaking devices are not typically convenient to use or flexible in their operation. Many shaking devices can be operated at only one speed or magnitude. Thus, an operator of a typical shaking device cannot adjust the speed or the magnitude of the shaking. Consequently, typical shaker devices are often limited to a "one size fits all" approach, and cannot be customized or even adjusted to fit the particular requirements of particular substances being shaken.

Further impeding the convenience of traditional shakers is the inability of such devices to process more than one container at a time. Multiple containers cannot typically be shaken at the same time unless the substances within the containers can be mixed. The inability to shake more than one container at a time is particularly inconvenient in the context of a "one size fits all" approach in the context of multiple containers.

Adding to the inconvenience of many shakers is the noise generated by the devices. Depending on the context of the particular device, unnecessary noise can result in a decision by a potential user to refrain from ever again invoking the shaker. This sensitivity can be particularly pronounced in highly consumer-oriented contexts, such as the use of a nail polish shaker.

SUMMARY OF THE INVENTION

The present invention relates to systems, apparatuses, and methods for shaking containers (collectively "shaker apparatus," "shaker," or simply the "apparatus"). The apparatus is configured to shake containers by producing dynamically changing motions. The dynamic motion prevents the separation of components within the shaken container that results from non-dynamic motion, such as the motion performed by a centrifuge.

Certain embodiments of the shaker can facilitate multiple containers, substantially quiet operations, multiple shaking magnitudes, and multiple shaking speeds.

DETAILED DESCRIPTION OF THE DRAWINGS

Certain embodiments of the present apparatuses and methods will now be described, by way of examples, with reference to the accompanying drawings, in which.

DETAILED DESCRIPTION

I. Structural Elements and Definitions

The present invention relates to systems, apparatuses, and methods for shaking containers (collectively "shaker apparatus," "shaker," or simply "the apparatus"). More specifically, the apparatus is configured to shake containers by producing dynamically changing motions.

The shaker apparatus can be used in a variety of different shaking contexts, including paint, nail polish, glue, chemical cleaning agents, drinks, and any other substance for which shaking is sometimes desirable. For example, the apparatus may be used to mix a substance or substances together, even when the substances have different densities. The apparatus can be implemented in a wide variety of different configurations. Numerous configurations and combinations can utilize one or more different embodiments of the apparatus.

In the following description, for purposes of explanation, numerous specific details are set forth in order to provide a thorough understanding of the present systems, methods, and apparatuses. It will be apparent, however, to one skilled in the art that the present methods and apparatuses may be practiced without all of the specific details of the disclosed examples. References in the specification to "some embodiments" or "some exemplary embodiments" do not necessarily all refer to the same embodiments.

Figure 1:
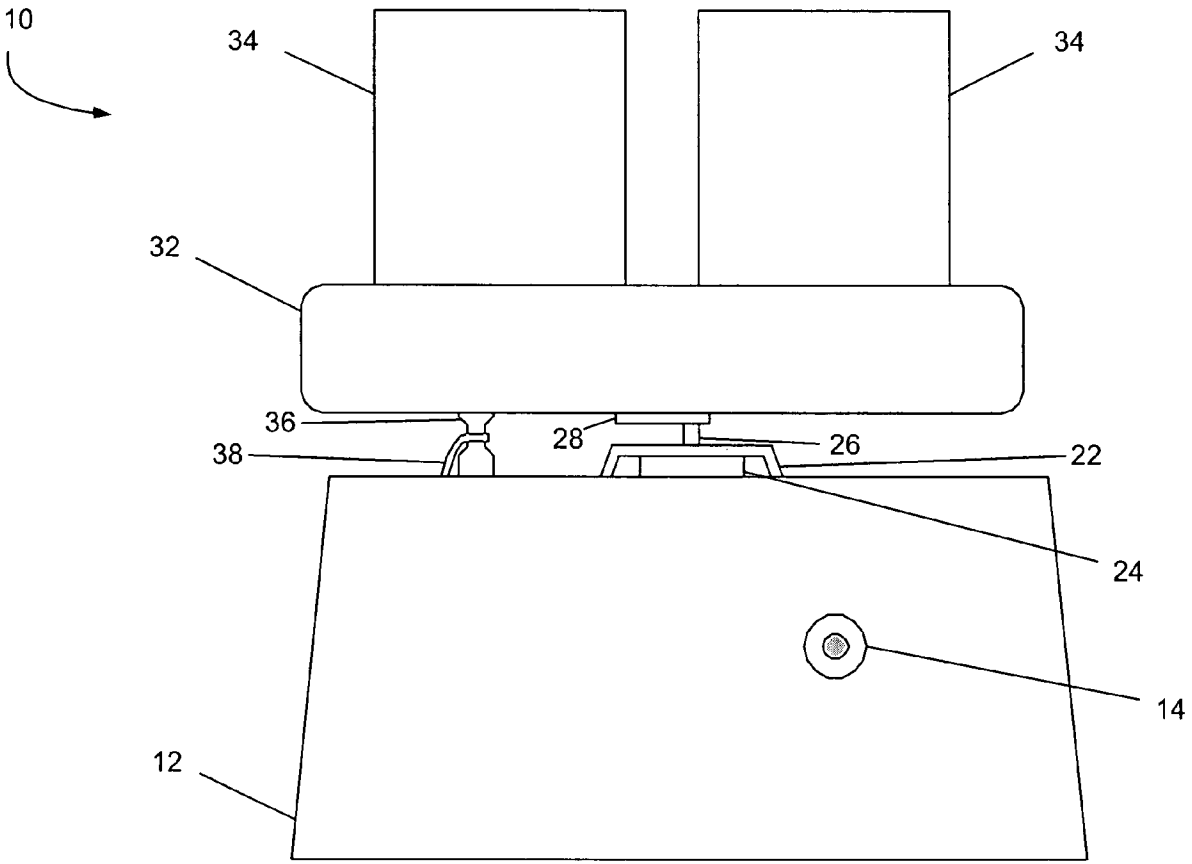
FIG. 1 is a side view diagram illustrating an example of a shaking apparatus.

Referring now to the drawings, FIG. 1 is a side view of an example of a shaker apparatus 10. The shaker apparatus 10 includes a base housing 12 that includes a power connector 14 and a switch 16 which is visible in FIG. 4. The base housing 12 is configured to house certain components of the shaker apparatus 10, including a base 18 that is visible in FIG. 2 and a base plate 20 that is visible in FIG. 2. The base 18 and the cantilevered base plate 20, which will be discussed in relation to FIG. 2, support a motor mount 22. The motor mount 22 supports a motor 24. The motor 24 can be coupled to a shaft 26, and the shaft 26 can be coupled to a cam or other form of wheel 28. The wheel 28 is configured to support a container base 32 by nesting into a bearing 30, which is visible in FIG. 3. The container base 32 is coupled to a number of container housings 34.

A. Base Housing

Figure 5:
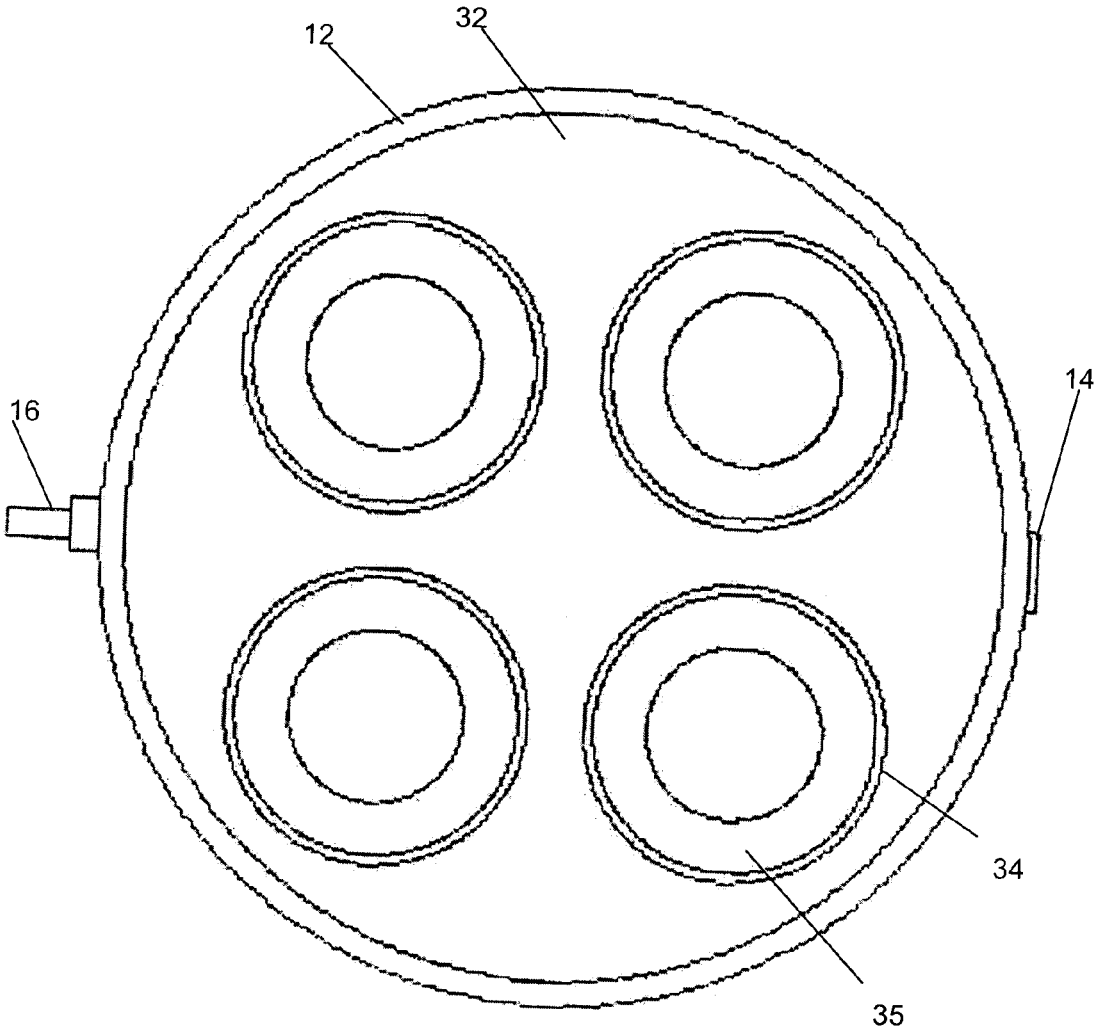
FIG. 5 is a top view of the shaking apparatus of FIG. 1.

The base housing 12 may be any shape capable of housing certain components of the shaker apparatus 10. In some embodiments, the base housing 12 is generally a hollow cylinder. FIG. 5 (discussed below) shows an example of the base housing 12 that is cylindrical in shape. The functionality of the shaker apparatus 10 is not dependent upon the base housing 12. Accordingly, the shaker apparatus 10 can function without the base housing 12.

The base housing 12 can be secured to the base 18 in a wide variety of ways, including but not limited to a bolt or a screw configuration. The base housing 12 may be made of any material or combination of materials capable of functioning to house components of the shaker apparatus 10, including plastics. Further, the base housing 12 may include a base pad that is configured to provide additional stability to the base housing 12. The base pad may be made of materials that increase the friction between the base housing 12 and a support surface. For example, the base pad can be perforated rubber.

B. Base

Figure 2:
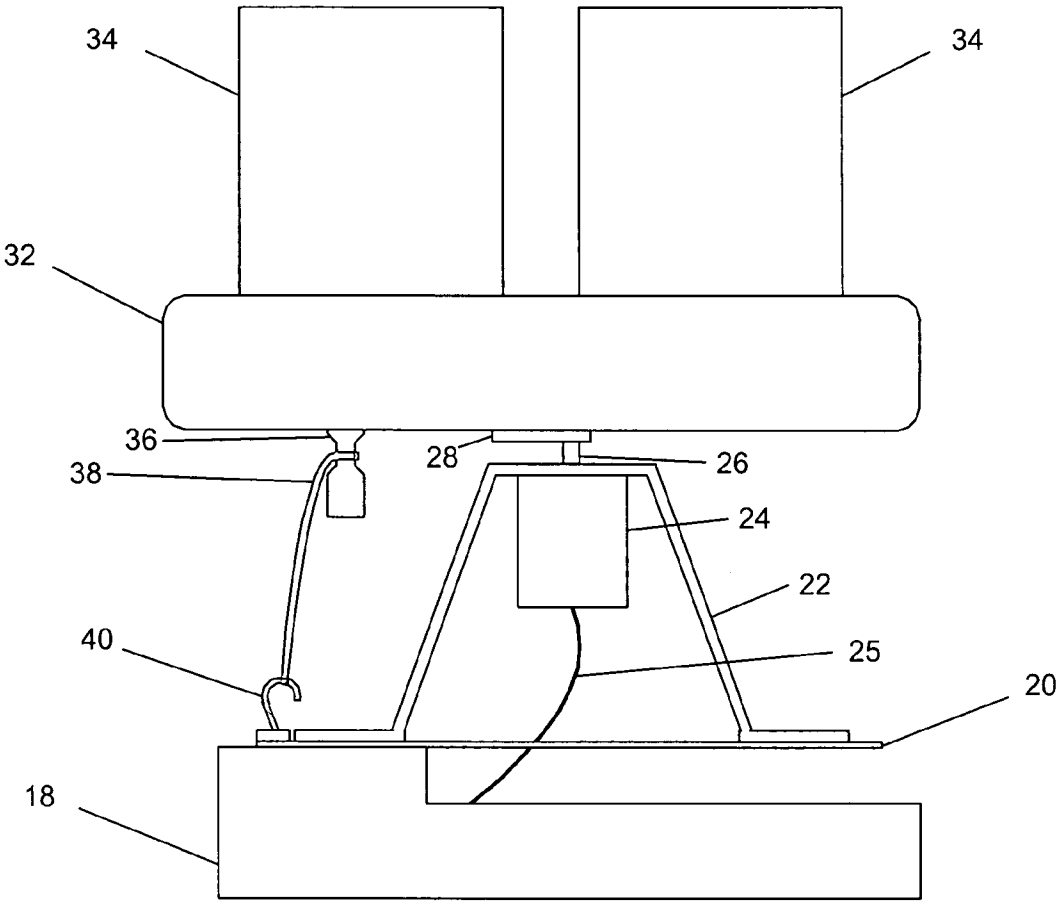
FIG. 2 is a side view diagram illustrating an example of a shaking apparatus of FIG. 1 with the base housing omitted.

FIG. 2 is a side view of an example of the shaker apparatus 10 with the base housing 12 omitted. The base 18 is configured to be positioned on a support surface. The base 18 can be made of a wide variety of materials capable of supporting the cantilevered base plate 20, such as a machined brass casting. Similar to the base housing 12, the base 18 may include a base pad that is configured to be positioned on the support surface and to support the base 18. The base pad supporting the base 18 can include any material or function described above in relation to the base pad of the base housing 12.

The base 18 can include an elevated portion that is configured to support the base plate 20, which can often be referred to as a cantilevered base plate. The base plate 20 is secured to the elevated portion of the base 18 such that part of the base plate 20 is suspended in a substantially horizontal manner above the base 18. A substantial portion of the base plate 20 is preferably suspended. The base plate 20 can be secured to the elevated portion of the base 18 in a number of ways, including but not limited to a bolt, a screw, or a welded configuration.

The base 18 should in many embodiments be stationary, or at least include stationary parts, relative to the unfixed portion of the base plate 20. In other words, the base 18 should not move relative to its support surface as the base plate 20 and any components supported by the cantilevered base plate 20 are moved according to the flex of the base plate 20.

C. Base Plate

By securing a fixed portion of the base plate 20 to the elevated portion of the base 18, the suspended portion of the base plate 20 is capable of flexing generally upward or downward according to a weight distribution or other forces that are applied to the cantilevered base plate 20. In many embodiments, the base plate 20 can often be referred to as a cantilevered based plate. When the base plate 20 is supporting an overall weight that is biased toward the suspended portion of the base plate 20, the base plate 20 will tend to flex downwardly. If the supported weight is biased toward the fixed portion of the base plate 20, then the base plate 20 will tend to flex upwardly. The base plate 20 can flex upwardly and downwardly with different degrees of flexion.

Because the suspended portion of the base plate 20 is configured to flex upwardly and/or downwardly, the base plate 20 can be made of any materials or combination of materials that can both flex and uphold the weight of the components supported by the base plate 20. In some embodiments, the cantilevered base plate 20 comprises cold rolled steel.

D. Motor Mount

The base plate 20 is configured to support the motor mount 22. The motor mount 22 can be coupled to the base plate 20 in a number of different ways, including but not limited to spot welding and bolt or screw configurations. The motor mount 22 shown in FIG. 2 has lower extensions for coupling to the base plate 20.

As discussed in relation to FIG. 1, the motor mount 22 supports the motor 24, the shaft 26, the wheel 28, the bearing 30, the container base 32, and the container housings 34. The motor mount 22 can be made of any material or combination of materials capable of supporting the above components, including steel. The motor mount 22 can be of any shape capable of supporting the motor 24 and the container base 32. As shown in FIG. 2, the motor 24 can be suspended from a raised portion of the motor mount 22.

E. Motor

The motor 24 can be any device capable of producing a rotational motion, including but not limited to an electric motor, a direct current (DC) motor, an alternating current (AC) motor, a gasoline-powered motor, a pneumatic motor, an air cylinder motor, and a crank motor. In some embodiments, the motor 24 is an electric motor capable of being energized by electrical energy to produce a rotational motion.

In some embodiments, the motor 24 is a variable speed motor that can produce different speeds of rotational motion. The speed of rotation produced by the motor 24 may change according to a change in the level of power or energy that is applied to the motor 24. For example, the speed of rotation produced by the motor 24 can decrease when the voltage level from a power source decreases.

F. Wire

Figure 4:
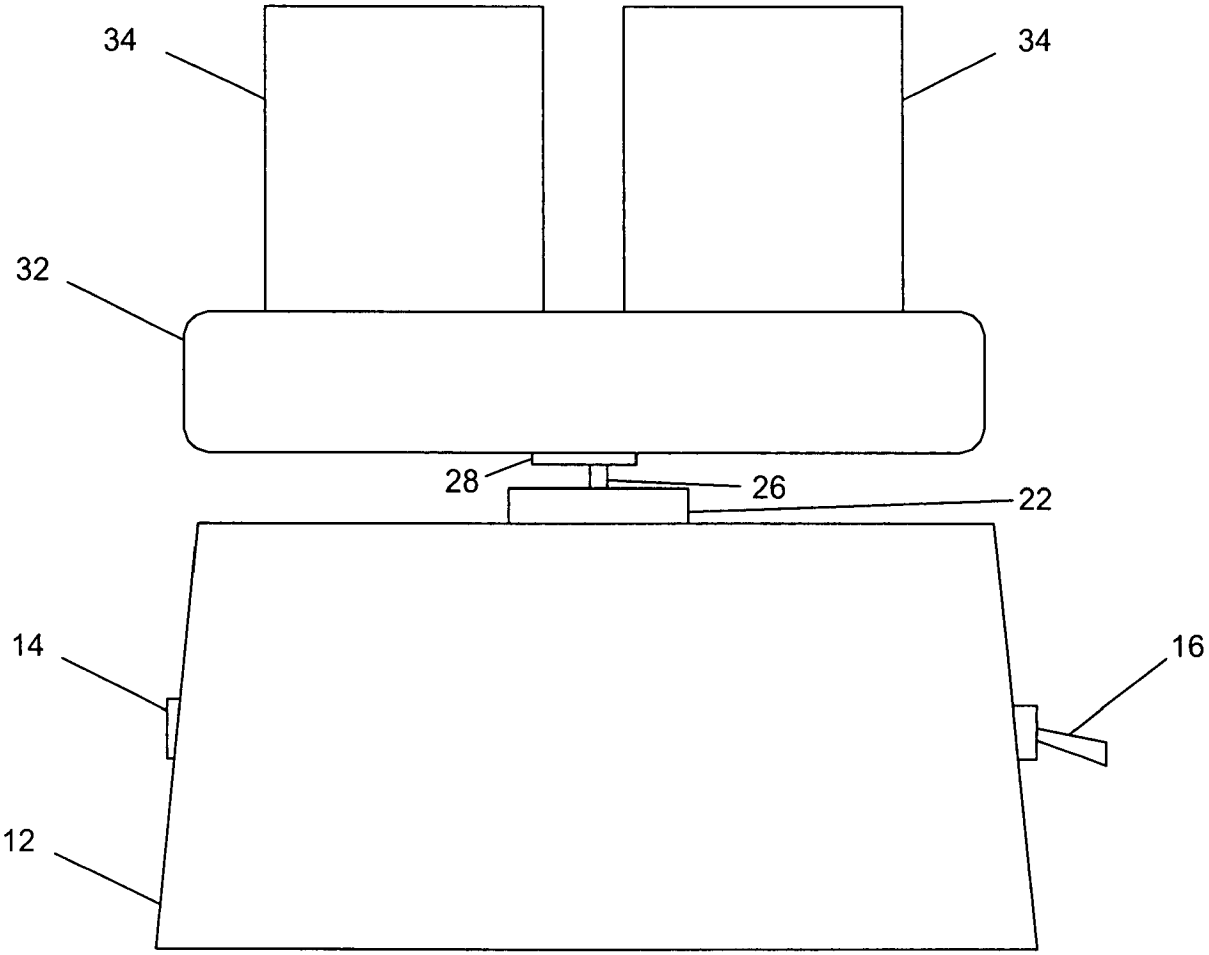
FIG. 4 is a front view diagram illustrating another example of a shaking apparatus with the retaining post omitted.

FIG. 2 shows an electrically conductive wire 25 connected to the motor 24. The wire 25 can be directly or indirectly connected to a power source and carry power to the motor 24 when a circuit between the motor 24 and the power source is completed. In addition to the motor 24, the wire 25, and the power source, some embodiments of the circuit include the power connector 14 and the switch 16, which are shown in FIG. 4.

G. Shaft

Referring back to FIG. 2, the motor 24 is coupled to a shaft 26. The shaft 26 is oriented generally in a vertical direction. The motor 24 is configured to cause the shaft 26 to rotate about the generally vertical axis of the shaft 26. The axis about which the shaft 26 is configured to rotate can angularly change orientation according to the flex of the cantilevered base plate 32. Accordingly, the generally vertical shaft 26 should be oriented according to the flex of the base plate 20, usually in a plane generally perpendicular to a surface of the base plate 20. The shaft 26 is coupled to the wheel 28 such that the rotating shaft 26 causes the offset wheel 28 to rotate eccentrically.

H. Wheel

As the shaft 26 rotates, the wheel 28 is configured to rotate eccentrically about the rotational axis of the shaft 26. In many embodiments, the wheel 28 can also often be referred to as a cam. As shown in FIG. 2, the shaft 26 is coupled to the wheel 28 at a location other than the center position of the wheel 28. The offset positioning of the shaft 26 in relation to the center of the wheel 28 facilitates the eccentric rotation about the rotational axis of the shaft 26.

Figure 3:
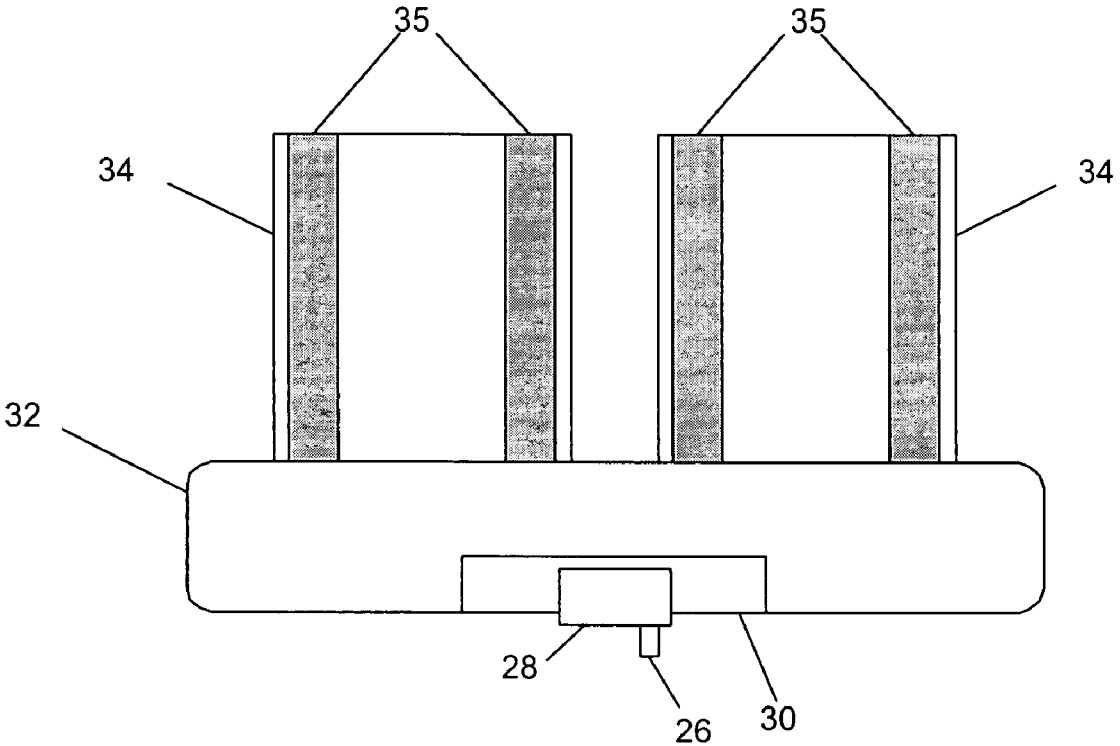
FIG. 3 is a cross-sectional view diagram illustrating examples of a number of components that can be used by the shaking apparatus of FIG. 1.

FIG. 2 does not show the wheel 28 in its entirety because the wheel 28 is configured to nest into a bearing 30, which is visible in FIG. 3 that is coupled to the container base 32. FIG. 3 is a cross-sectional view of the shaker apparatus 10 that shows the wheel 28 nested in the bearing 30. The bearing 30 is positioned within a recess of the container base 32.

When the container base 32 is positioned and rested on the wheel 28, the wheel 28 can nest into an opening of the bearing 30. As shown in FIG. 3, the opening is preferably of sufficient diameter to allow the wheel 28 to eccentrically rotate within the bearing 30. A number of different sizes of the wheel 28 and the bearing 30 can be used. Similarly, the wheel 28 and the bearing 30 can be made of a number of different materials. In some embodiments, the bearing 30 is a roller bearing in which an orifice of the bearing has a diameter of approximately ⅝ inches. In some embodiments, the wheel 28 includes a machined ¾ inch brass stock.

Because the wheel 28 is coupled to the shaft 26, the orientation of the wheel 28 changes in substantial or general according with the flex of the base plate 20. Preferably, the wheel 28 spins in a plane that is approximately perpendicular to the generally vertical shaft 26 or axis. The spinning of the wheel 28 within the bearing 30 causes the container base 32 to laterally translate with respect to the generally vertical axis. Accordingly, the direction of translation of the container base 32 should be in a plane that is generally parallel to the plane within which the wheel 28 spins.

I. Container Base

The container base 32 is coupled to the bearing 30, which bearing 30 is configured to be positioned about the wheel 28. The eccentric rotation of the wheel 28 within the bearing 30 causes the container base 32 to move in various lateral directions. Specifically, as the wheel 28 spins within the bearing 30, the bearing 30 changes positions relative to the wheel 28. The orifice of the bearing 30 is preferably large enough to allow the wheel 28 to locate at different positions within the bearing. The movements of the bearing 30 in relation to the wheel 28 facilitate generally lateral motions of the container base 32. In other words, the container base 32, because it is coupled to the bearing 30, translates or moves laterally as the wheel 28 rotates.

For example, at a particular position of rotation, the radially outermost part of the wheel 28 is maximally extended over the suspended portion of the base plate 20. At this position, the container base 32 undergoes a lateral force in the direction of extension. This can be referred to as the maximum forward lateral force. At the opposite positioning of the cam 28, where the outermost part of the cam is maximally extended over the fixed portion of the cantilevered base plate 20, the container base 32 undergoes a maximum rearward lateral force. The lateral motions can be referred to as back-and-forth, in-and-out, side-to-side, or generally horizontal motions.

The lateral translations can include both radially outward motions and radially inward motions. When the radially outermost part of the cam 28 is moving away from the shaft 26, the container base 32 should translate in a radially outward direction. On the other hand, when the radially outermost part of the cam 28 is moving toward the shaft 26, the container base 32 should translate in a radially inward direction.

The lateral motions of the container base 32, also referred to as lateral translations, occur in various radially outward directions over a 360 degree range. The rotation of the cam 28 within the bearing 30 causes the lateral motions to occur in different directions. As the container base 32 translates laterally in accordance with the rotation of the cam 28, the center of motion or the distributed weight of the container base 32 shifts. Further, the center of motion of any substance within a container that is coupled to the container base 32 also shifts as the container base 32 translates.

The translations of the container base 32 can facilitate generally vertical motions. When the weight distribution of the container base 32 shifts due to the translational motion, the base plate 20 flexes accordingly. For example, when the weight of the container base 32 is biased toward the outer edge of the suspended portion of the base plate 20, the base plate 32 flexes downwardly. Consequently, the container base 32 is subjected to a generally vertical downward motion. On the other hand, a generally vertical upward motion occurs when the weight is biased toward the fixed portion of the base plate 20. Thus, the base plate 32 is subjected to generally vertical, or up and down, motions.

The translational motions of the container base 32 generate a momentum of the container base 32 and any containers secured thereto. Similar to the example given above, a radially outward motion of a container away from the generally vertical axis produces a momentum of the container, including a velocity in the radially outward direction. This momentum helps cause the base plate 20 to flex downwardly.

The generally vertical motions of the container base 32 can also be referred to as a tilting of the container base 32. The container base 32 tends to tilt with respect to a horizontal surface in accordance with the flex of the base plate 20. As the base plate 20 flexes, any component supported by the base plate 20 tilts corresponding to the flex, including the shaft 26, the generally vertical axis, the container base 32, and any containers supported by the container base 32. As a result, the directional orientation of the lateral translation of the container base 32 changes in general or even substantial accordance with the tilting.

The tilting causes the axis of rotation of the shaft 26 to angularly tilt, thereby tilting the respective planes within which the cam spins and the container base translates. Preferably, these planes are tilted at approximately equal amounts with respect to a horizontal surface such that the planes maintain an approximately parallel relation to one another.

The generally vertical tilting of the container base 32 can further facilitate a change in the center of motion of the container base 32 and the substances within the containers secured to the container base 32. The translation and the tilting of the container base 32 work together to simultaneously subject the containers to multidirectional, generally random, and awkward shaking motions. The combined motions serve to quickly, thoroughly, efficiently, and quietly mix the substances contained by the containers. In some embodiments, the apparatus 10 (in an uncovered state) can generate as little as approximately:

- 1 decibel of noise at a distance of two feet from the apparatus 10 when then apparatus 10 is unloaded and operating at a relatively low speed;
- 2 decibels of noise at a distance of two feet from the apparatus 10 when the apparatus 10 is unloaded and operating at a relatively high speed;
- 2 decibels of noise at a distance of two feet from the apparatus 10 when the apparatus 10 is loaded with a 3 oz. bottle and operating at a relatively low speed; and
- 4 decibels of noise at a distance of two feet from the apparatus 10 when the apparatus 10 is loaded with a 3 oz. bottle and operating at a relatively high speed.

In some embodiments, the apparatus 10 (in a covered state) can generate as little as approximately:

- 1 decibel of noise at a distance of two feet from the apparatus 10 when the apparatus 10 is unloaded and operating at a relatively low speed;
- 2 decibels of noise at a distance of two feet from the apparatus 10 when the apparatus 10 is unloaded and operating at a relatively high speed;
- no detectible sound deviation from ambient conditions at a distance of two feet from the apparatus 10 when the apparatus 10 is loaded with a 3 oz. bottle and is operating at a relatively low speed; and
- no detectible sound deviation from ambient conditions at a distance of two feet from the apparatus 10 when the apparatus 10 is loaded with a 3 oz. bottle and is operating at a relatively high speed.

Different embodiments of the apparatus 10 can function within different noise tolerances. In certain embodiments, noise may not be a concern, while in other embodiments the lack of noise is an important characteristic of the apparatus 10. For consumer-related embodiments, it can be desirable to limit the noise of the apparatus to approximately 10 decibels at a distance of two feet.

The motions generated by the apparatus 10 counter-act the tendency of different density substances to separate. These motions are preferably rapidly repeated to agitate the containers in a wide variety of dynamically changing directions and at different magnitudes. Accordingly, the varying multi-directional motions facilitate a mixing of the substances rather than a separation. For example, the apparatus 10 causes the centers of motion of the containers to rapidly change so that substances to not begin to settle in relation to an unchanging center of motion. Further, the wide variety of varying motions allows quiet operation of the apparatus 10, while still thoroughly mixing the contents of the containers.

The container base 32 can be coupled to a number of similar or different container housings 34. The container housings 34 can be secured to the container base 32 in a wide variety of ways. The container base 32 can be made of any material or combination of materials capable of supporting the container housings 34 and any number of containers housed by the container housings 34. In some embodiments, the container base 32 is made at least in part of a plastic material or a combination of plastic materials.

J. Container Housings

The container housings 34 are configured to potentially carry containers. FIG. 5 shows a top view of the container shaker apparatus 10. As shown in FIG. 5, the container housings 34 may be cylindrically shaped. However, the container housings 34 can be any shape capable of housing a container during operation of the shaker apparatus 10. The container housing 34 can include a rigid material such as polyvinyl chloride (PVC). FIG. 3 shows a cross-sectional view of the container housings 34.

As shown in FIG. 3 and FIG. 5, each container housing 34 can include a container cushion 35. The container cushion 35 is configured to receive and retain a container during shaking operations. The container cushion 35 can be made of any material or materials capable of retaining the container within the container housing 34 during shaking of the container. The container cushion 35 should be able to protect the container from damage during shaking. In some embodiments, the container cushion 35 is a foam or rubber-based material. In some embodiments, the container cushion 35 includes a fastening device for securing the container.

Because the container housings 34 are secured to the container base 32, the container housings 34 generally undergo the same motions experienced by the container base 32. Accordingly, any container housed by the container housing 34 generally experiences the same motions, and any substances within the container are caused to mix. The motions can be of various magnitudes depending on the power level supplied to the motor 24. Consequently, substances within the containers can be agitated at different magnitudes, from a gentle stir to a vigorous shake.

The container can be any object that can be secured to the container housing 34 and that is capable of carrying a substance, an object, or any combination of substances and objects. In some embodiments, the container is a bottle of nail polish. In some embodiments, the container is a test tube, a flask, or a beaker. In some embodiments, the container contains one or more liquid-like substances, including but not limited to paint, glue, nail polish, and the like.

K. Retaining Post

Referring back to FIG. 2, the container base 32 is coupled to a retaining post 36. As shown in FIG. 2, the retaining post 36 can be suspended from the container base 32. The entirety of the retaining post 36 is not visible in FIG. 2 because the retaining post 36 may partly nest within the container base 32. Further, the retaining post 36 may extend downward below the upper edge of the base housing 12 as shown in FIG. 1.

The retaining post 36 can be any structure capable of being secured to the container base and of being coupled to a retaining band 38. For example, the retaining post 36 can include two ends with diameters larger than the diameter of a central segment of the retaining post 36. Accordingly, the retaining post 36 shown in FIG. 2 is configured to be secured by the retaining band 38. The retaining post 36 can be made of a number of different materials, including a variety of plastics.

L. Retaining Band

The retaining band 38 can be coupled at one end to the retaining post 36 in a wide variety of ways, including by wrapping the retaining band 38 around the retaining post 36. The retaining band 38 can be any stretchable and recoilable material, such as an elastic band, a rubber band, or a spring. The other end of the retaining band 38 is coupled to a retaining bracket 40.

M. Retaining Bracket

FIG. 2 shows the retaining band 38 coupled to the retaining bracket 40. The retaining band 38 can be coupled to the retaining bracket 40 in a number of ways, such as being wrapped around the retaining bracket 40. The retaining bracket 40 can be any shape and material capable of being coupled to the retaining band 38, including a hook-shaped apparatus. In FIG. 2, the retaining bracket 40 includes a hook secured to the portion of the base plate 20. The retaining bracket 40 may be secured to other components of the shaker apparatus 10, preferably stationary components. For example, the retaining bracket 40 may be secured to the base 18, the base housing 12, the base plate 20, or the motor mount 22.

The configuration of the retaining post 36, the retaining band 38, and the retaining bracket 40, collectively referred to as the retaining mechanism, function to further control the shaking motions of the container base 32. For example, the retaining mechanism may help keep the bearing 30 of the container base 32 nested on the cam 28 during shaking operations. Further, the retaining band 36 may function to introduce forces upon the container base 32, which forces cause the container base 32 to experience more directions or types of motion. For example, the retaining mechanism may function to help change the velocity of the container base 32, such as by changing the direction of motion for the container base 32.

If the container base 32 is in a position that causes the base plate 20 to maximally flex downwardly, the retaining band 36 is maximally stretched as the container base 32 tilts downwardly according to the flex of the base plate 20. The tilt causes the portion of the container base 32 connected to the retaining post 36 to move upwardly, causing the retaining band 38 to stretch. The stretched retaining band 38 functions to pull downwardly on the upward positioned portion of the container base 32. Accordingly, the force applied by the retaining mechanism helps facilitate a change in the direction of motion of the container base 32 by subjecting the container base 32 to a generally downward force as the retaining band 38 recoils.

The retaining mechanism can be configured to control the motions of the container base 32 in different ways. In the example above, the retaining band 38 can be used to dampen the up-down tilt range of the container base 32. Accordingly, the shaking motions resulting from the tilt of the container base 32 are dampened.

To change the effects of the retaining mechanism on the motions of the container base 32, the retaining band 36 can be of a different length, flexibility, or tautness. Assuming the operator of the shaker apparatus 10 wishes to dampen the shaking motion, the operator may use a retaining band 36 that is taut in order to shorten the range of shaking motions. On the other hand, a very stretchable retaining band 36 would tend to facilitate a wider range of motions experienced by the container base 32.

Further, the retaining mechanism may function to dampen the motions of the container base 32. For example, the retaining mechanism may help prevent the container base 32 from tilting or translating beyond a certain extent. In addition, the retaining mechanism can help maintain the quiet operation of the shaker apparatus 10. Even when the shaker apparatus 10 is vigorously shaking the container base 32, the retaining mechanism can function to dampen the movements and maintain both quiet and vigorous shaking actions.

N. Power Connector

FIG. 4 is a front view of the example of the shaker apparatus 10 of FIG. 1. As shown, the power connector 14 and the switch 16 are coupled to the base housing 12. The power connector 14 is configured to connect to a power source, and the wire 25 connects the power source to the motor 24. In some embodiments, the power connector 14 is a receptacle for a direct current (DC) power source. In some embodiments, the power source is disposed within the base housing 12 and electrically connected to the motor 24. In some embodiments, the power source is a battery.

The power source may be a variable source of power. For example, the power source can be a DC variable voltage power source. By varying the power levels supplied to the motor 24, the operator of the shaker apparatus 10 can control the magnitude of the shaking motions produced by the shaker apparatus 10. Consequently, the shaker apparatus 10 can provide customized shaking motions for specific shaking applications.

O. Switch

The switch 16 is configured to control the power to the motor 24. The switch 16 can power the shaker apparatus 10 "on" and "off." Accordingly, the switch 16 is electrically connected to the motor 24 and to the power connector 14 or the power supply. The switch 16 is configured to open or close the circuit between the motor 24 and the power source. The switch 16 may be configured to control the speed of the rotation of the motor 24. For example, the switch 16 can include a number of settings corresponding to different levels of power. In some embodiments, the switch 16 is a toggle switch.

Figure 6:
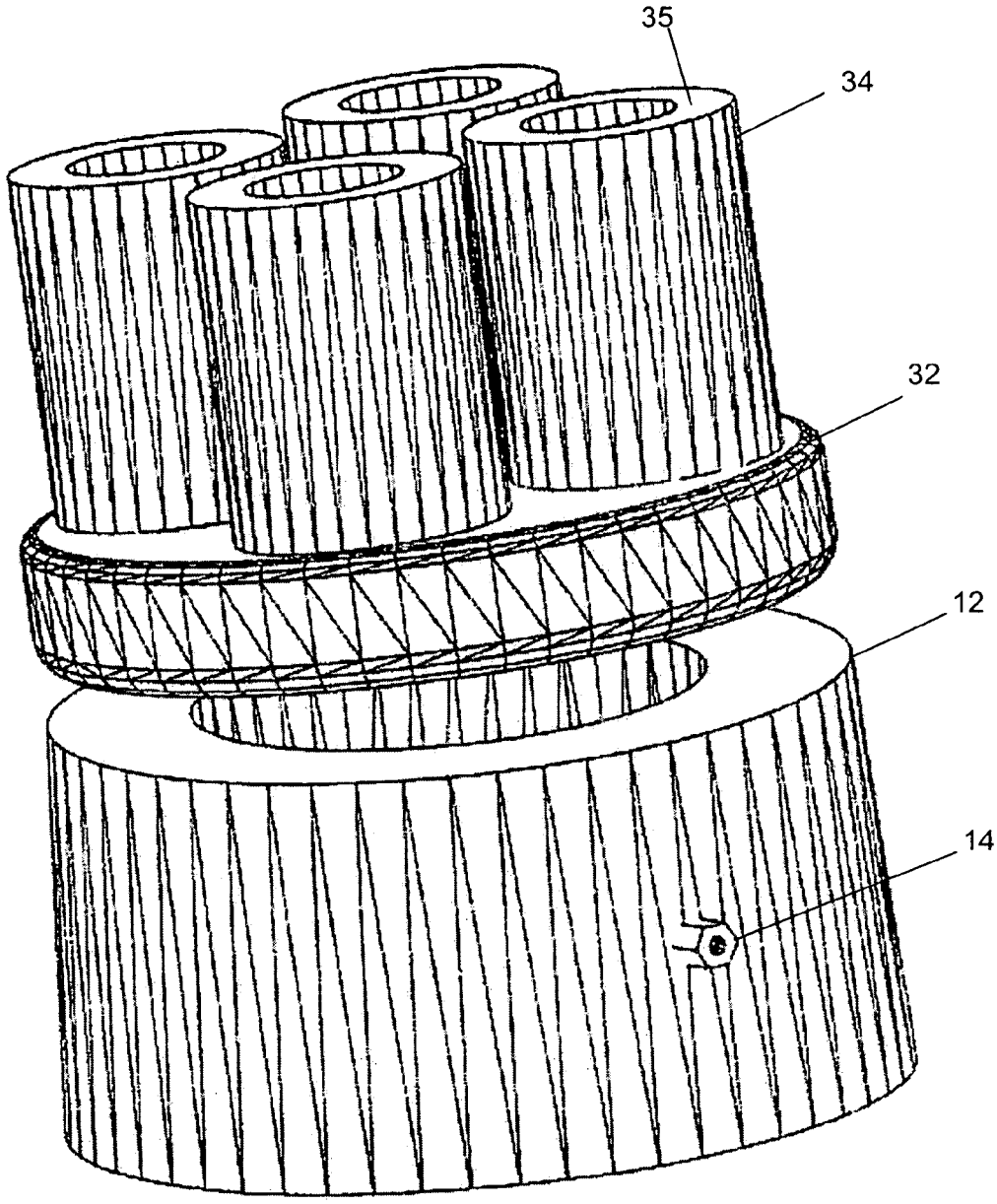
FIG. 6 is a perspective view of the shaking apparatus of FIG. 1.

FIG. 6 is a perspective view of an example of the shaker apparatus 10. As shown in FIG. 6, the container base 32 is configured to respond to the various forces exerted upon it by the wheel 28, the retaining mechanism 38, and the base plate 20. The random and awkward movements of the container base 32 facilitate the mixing or shaking of any substance in a container positioned in the container housing 34. The random movements can occur simultaneously and rapidly to efficiently mix substances. Thus, the containers being shaken experience rapid changes in their centers of motion as the random multi-directional forces are applied to the container base 32. The containers are subjected to up-and-down, in-and-out, and side-to-side motions at various radial angles around the generally vertical rotational axis of the shaft 26. The containers also undergo up-and-down motions according to the flexions of the cantilevered base plate 20. The multitude of motions thoroughly, quickly, quietly, and efficiently shakes the containers.

II. Process Flow View

Figure 7:
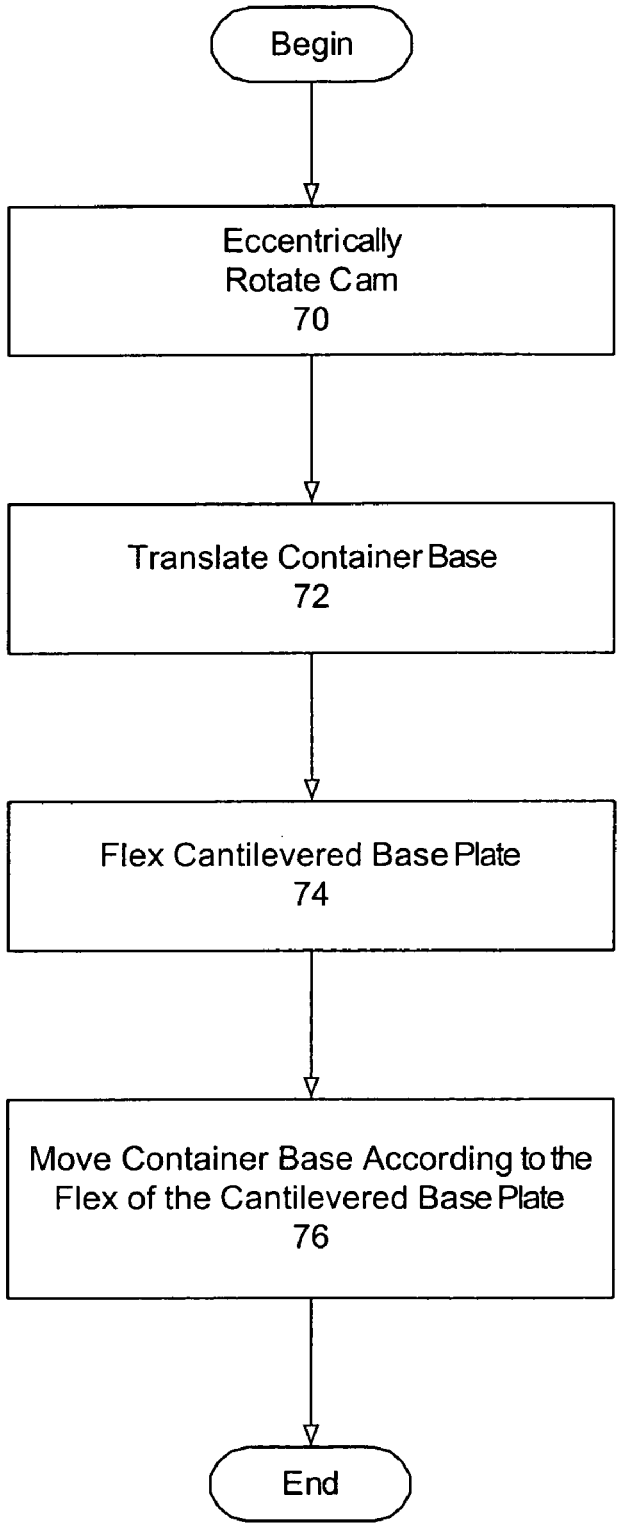
FIG. 7 is a flow-diagram of an example of a method for shaking containers.

FIG. 7 is a flowchart diagram illustrating an example of a method for shaking containers. At 70, the method begins by eccentrically rotating the wheel 28. The wheel 28 rotates within the orifice of the bearing 30 as discussed above. At 72, the rotation of the wheel 28 causes the container base 32 to translate as discussed above. As discussed above, the translation or other movement ay 74 causes a change in the distributed weight of the container base 32 and the momentum of the containers, thereby resulting in a tilting of the container base 32 due to a flexing of the cantilevered base plate 20. The retaining band 38 causes changes in direction (in and out and back and forth) as discussed above. The steps of the method shown in FIG. 7 are executed in any of the ways discussed above.

III. Alternative Embodiments

In many embodiments, the apparatus is portable, and can be easily carried and transported. For example, in a nail polish shaker embodiment of the apparatus 10, even a small woman would be able to easily pack the apparatus 10 into a travel bag, and use the apparatus 10 in her hotel room. In other embodiments, such as industrial paint shaking embodiments, portability may be less important and the apparatus 10 may as a result be less portable. In one consumer-oriented embodiment, the apparatus will weigh 8 lbs. 12 oz. (approximately 3.9689 kg) with the container holder, and 7 lbs. 10 oz. (approximately 3.4586 kg) without the container holder. The cover for the apparatus 10 in such an embodiment weighs 2 lbs 3 oz. (approximately 0.9922 kg). In other consumer-oriented embodiments (particularly in such contexts as nail polish shakers where portability can be important), it can be desirable for the apparatus 10 to weigh approximately 15 lbs (6.8039 kg) or less.

The various embodiments of the apparatus 10 can be manufactured in a wide variety of different ways using a wide variety of different processes and materials. For example, with respect to manufacturing processes, some components of the apparatus 10 such as the base housing 12, the container housings 34, and the container base 32 can be manufactured by an injection molding process. In such an embodiment, the container base 32 may require webbing. With respect to material composition, many of the components of the apparatus 10 can be metallic, plastic, or virtually any other material capable of meeting the structural requirements necessary for the functionality of the apparatus 10. Plastic, rubber, and metallic components can be incorporated into the same embodiment of the apparatus 10.

With respect to power sources, the apparatus 10 can be configured to be: (a) exclusively powered by an internal power source such as a battery; (b) exclusively powered by an external power source such as a conventional power outlet; or (c) powered either through internal or external sources. Gas, diesel, and a variety of other power sources can be used to power the apparatus 10.

The foregoing embodiments were chosen and described in order to illustrate principles of the methods and apparatuses as well as some practical applications. The preceding description enables others skilled in the art to utilize the methods and apparatuses in various embodiments and with various modifications as are suited to the particular use contemplated. It is intended that the scope of the present methods and apparatuses be defined by the following claims. In accordance with the provisions of the patent statutes, the principles and modes of operation of this invention have been explained and illustrated in exemplary embodiments. However, it must be understood that this invention may be practiced otherwise than is specifically explained and illustrated without departing from its spirit or scope.

What is claimed is:

1. An apparatus for shaking a container, comprising:

a base plate, wherein said base plate is a cantilevered base plate;

a motor mount supported by said base plate;

a motor coupled to said motor mount a shaft, wherein said motor is configured to rotate said shaft;

a wheel coupled to said shaft, wherein said wheel is configured to eccentrically rotate about said shaft, and wherein said wheel is a cam;

a bearing, wherein said wheel is configured to rotate within said bearing;

a container base coupled to said bearing such that said container base is configured to move in substantial accordance with said eccentric rotation of said wheel while dynamically tilting in a vertical direction, resulting in a vertical movement that is not de minimis; and at least one container coupled to said container base, and wherein the container tilts in substantial accordance with the translation of said container base;

wherein said base plate is configured to flex according to said translation of said container base, wherein said base plate is made of a material that allows said base plate to flex generally downward as said container base moves away from a fixed portion of said base plate and wherein said base plate is made of a material that allows said based plate to flex generally upward as said container base moves toward a fixed portion of said base plate.

2. The apparatus of claim 1, wherein said flex facilitates a tilting of said container base and at least one container with respect to a horizontal surface of said base, wherein said tilting occurs in a first plane that is perpendicular to a second plane in which the rotation of said wheel, wherein said of said container base facilitates a change to a center of motion of at least one said container, and wherein said tilting is not de minimis.

3. The apparatus of claim 1, wherein said base housing is made of plastic and includes a rubber base pad, wherein said motor mount is made of steel, and wherein said cam is made of brass.

4. The apparatus of claim 1, wherein a retaining mechanism is coupled to said container base, said retaining mechanism being configured to dampen an up-down tilt range of said container base, and wherein said retaining mechanism changes a direction of motion of said container base, and wherein said retaining mechanism includes at least one of: (a) an elastic band; (b) a rubber band; and (c) a spring.

5. The apparatus of claim 1, wherein the motion of said container base and said flex of said base plate facilitate a mixing of liquid contents within at least one said container by impacting the motion of said container, and wherein the motion of said container base and said flex of said base plate is dynamic such that it does not cause separation of contents within at least one said container when said contents comprise substances with different densities.

6. The apparatus of claim 1, wherein at least one said container is a sealed 3 oz. bottle.

7. The apparatus of claim 1, further including a variable power source configured to adjust a rotational speed of said shaft, and wherein the mass of said apparatus is less than approximately 6.8 kilograms.

8. The apparatus of claim 1, wherein said apparatus provides for generating no more than approximately 10 decibels of noise during operation of said apparatus at a distance of 2 feet from said apparatus when said apparatus is covered by a base housing.

9. The apparatus of claim 1, said apparatus further comprising a retaining post and a retaining band, wherein said base plate includes a rubber component and a steel component, wherein said retaining post includes a plastic component, and wherein said retaining band is a rubber band.

10. The apparatus of claim 1, wherein said container base provides for coupling with up to five sealable 3 oz. bottles, and wherein said apparatus is a nail polish shaker.

11. The apparatus of claim 10, wherein said nail polish shaker is configured to shake as many as four containers simultaneously.

12. The apparatus of claim 1, wherein said apparatus has a mass no greater than approximately 4 kilograms.

13. The apparatus of claim 1, said apparatus further comprising a power source, wherein said power source is an internal battery.

14. The apparatus of claim 1, said apparatus further comprising a power source, wherein said power source is a cord configured to receive power from an external power source.

15. A shaking device, comprising:

a wheel configured to spin; and a container base interfacing with said wheel such that said container base is configured to dynamically tilt while spinning in general accordance with said spinning of said wheel, wherein said container base is configured to secure the position of the container on said container base while said container base is in motion, and wherein a retaining mechanism is coupled to said container base, said retaining mechanism being configured to dampen an up-down tilt range of said container base;

a retaining mechanism configured to change a direction of motion of said container base, wherein said retaining mechanism includes at least one of: (a) an elastic band; and (b) a rubber band;

wherein said tilting to said container and said container base is caused at least in part by a base plate configured to flex.

16. The shaking device of claim 15, wherein a retaining mechanism is coupled between said container base and a stationary part of said shaking device.

17. The shaking device of claim 15, wherein said tilting facilitates a change to a center of motion of said at least one said container, and wherein at least one said container dynamically tilts while spinning along with the container base.

18. The shaking device of claim 15, wherein said base plate is configured to flex generally downward as said container base translates away from a supported portion of said base plate, wherein said base plate is configured to flex generally upward as said container base translates toward a supported portion of said cantilevered base plate.

19. A method for shaking containers, comprising:

eccentrically rotating a wheel about a substantially vertical axis;

laterally moving a container base in substantial accordance with said eccentric rotation of said wheel, wherein said container base is configured to support at least one container; and tilting said container base with respect to a horizontal surface based on the movement of said container base such that a directional orientation of said lateral translation of said container base changes in substantial accordance with said tilting;

wherein said tilting is caused by a base plate configured to flex according to said the lateral movement of said container base, and wherein said base plate is configured to flex generally downward as said container base moves away from a fixed portion of said base plate.

20. The method of claim 19, wherein said base plate is configured to flex generally upward as said container base translates toward a fixed portion of said base plate, wherein said tilting facilitates a change to a center of motion of said at least one said container.

21. The method of claim 20, further comprising tilting said wheel based on the movement of said container base, wherein said wheel and said container base tilt at approximately the same angle with respect to said horizontal surface.

22. The method of claim 19, wherein the movement of said container base includes a substantially radially outward motion and a substantially radially inward motion, and where the lateral movement of said container base occurs in varying radial directions around said generally vertical axis.

* * * * *